US011199815B2

(12) United States Patent
Tschumi

(10) Patent No.: US 11,199,815 B2
(45) Date of Patent: Dec. 14, 2021

(54) ORIENTABLE SCREWED CROWN

(71) Applicant: MECO SA, Grenchen (CH)

(72) Inventor: Philipp Tschumi, Niederwil (CH)

(73) Assignee: MECO SA, Grenchen (CH)

( * ) Notice: Subject to any disclaimer, the term of this patent is extended or adjusted under 35 U.S.C. 154(b) by 0 days.

(21) Appl. No.: 16/881,137

(22) Filed: May 22, 2020

(65) Prior Publication Data

US 2021/0109481 A1 Apr. 15, 2021

(30) Foreign Application Priority Data

Oct. 9, 2019 (EP) ..... 19202188

(51) Int. Cl.
*G04B 37/10* (2006.01)
*G04B 3/04* (2006.01)

(52) U.S. Cl.
CPC ..... *G04B 37/103* (2013.01); *G04B 3/041* (2013.01)

(58) Field of Classification Search
CPC ..... G04B 37/103; G04B 3/041; G04B 3/04; G04B 3/043; G04B 19/283; G04B 47/044; G04B 37/10; G04B 37/106; G04B 37/04
USPC ..... 368/288
See application file for complete search history.

(56) References Cited

U.S. PATENT DOCUMENTS 10,152,024 B2 * 12/2018 Baebler ..... G04B 37/10
10,228,656 B2 * 3/2019 Waeckerlin ..... G04B 3/043
10,613,481 B2 * 4/2020 Iguchi ..... G04B 3/046
2007/0247978 A1 10/2007 Carrard et al.
2013/0114383 A1 5/2013 Gourdin
2014/0071797 A1 3/2014 Knuchel et al.

FOREIGN PATENT DOCUMENTS

EP 1 857 892 A1 11/2007
EP 2 592 500 A1 5/2013
JP 2004-271361 9/2004
JP 2004-271362 9/2004
JP 2010-19823 1/2010
WO WO 2012/168243 A1 12/2012

OTHER PUBLICATIONS

European Search Report dated Mar. 18, 2020 in European Application 19202188.9 filed Oct. 9, 2019 (with English Translation of Categories of Cited Documents), 4 pages.
Chinese office action dated Aug. 24, 2021, in corresponding Chinese patent application No. 2021081902001610., filed Jul. 23, 2020, 18 pages, with partial English translation.
Notice of Reasons for Refusal dated Aug. 31, 2021, in corresponding Japanese patent application No. 2020-139086, filed on Aug. 20, 2020, (11 pages), with partial English translation.

* cited by examiner

*Primary Examiner* — Edwin A. Leon
(74) *Attorney, Agent, or Firm* — Oblon, McClelland, Maier & Neustadt, L.L.P.

(57) ABSTRACT

A watch case, including an orientable screwed crown including axially movable, a subassembly including a setting body including a pattern, a tube suitable for being axially inserted into a hole of the case and including an axial indexing profile engaging complementarily with a complementary axial indexing profile of the hole, and the indexing profile is a cone of apex angle less than 15°, arranged to engage by friction with the complementary indexing profile of the hole.

16 Claims, 3 Drawing Sheets

ORIENTABLE SCREWED CROWN

CROSS-REFERENCE TO RELATED APPLICATION

This application claims priority to European Patent Application No. 19202188.9 filed on Oct. 9, 2019, the entire disclosure of which is hereby incorporated herein by reference.

FIELD OF THE INVENTION

The invention relates to a watch case, including a middle part with at least one through hole for receiving an orientable screwed crown, said orientable screwed crown being arranged to engage with said hole and seal same tightly, said orientable screwed crown including a pattern on an end face or in the vicinity thereof, said orientable screwed crown including, axially movable along an axial direction in relation to one another, on one hand, a subassembly including a crown body suitable for being handled by a user and including said pattern, and, on the other, a tube arranged to be screwed or driven into said hole along said axial direction.

The invention further relates to a timepiece, particularly a watch, including such a case.

The invention further relates to a method for assembling such an orientable screwed crown.

The invention further relates to a method for fitting such an orientable screwed crown on a watch case.

BACKGROUND OF THE INVENTION

Screwed crowns are routinely used for equipping watches with a view to enhancing the water-tightness thereof at the level of the passage of a control organ, such as a winding or control rod. This type of crown has the specificity of being able to adopt an unscrewed position wherein the watch can be wound, hand-set, regulated, or other, and a screwed position wherein the crown is screwed and locked on a tube driven or screwed into the middle part of the watch case in order to compress a seal, thus enhancing the water-tightness of the watch. The screwed position is therefore that corresponding to the normal position when the watch is worn and which is more or less always the same, subject to the wear of the seal.

The manufacture and fitting of these screwed crowns on watch cases are well known. However, the methods for fitting these crowns are ill-suited to screwed crowns bearing on the end face thereof an inscription or a pattern, for example a logo, a hallmark or a similar sign, or indeed a profile, or to crowns which are not revolving, whereas it is desirable that the user, or at the very least an after-sales service, be able to regulate the angular indexation of such a crown, in the screwed position, according to a desired particular orientation.

Indeed, known fitting methods are not generally suitable for placing the crown in a defined orientation with respect to the case after the screwing thereof, which may harm the aesthetics of the case. This situation is obviously unacceptable when these crowns are fitted in luxury and high-quality products.

The document EP2592500 held by ROLEX describes a watch case comprising a middle part, a first tube equipped with first indexing means, a control crown including a cover having a distinctive sign on a front face and a pipe intended to be connected to the watch movement, a second tube envisaged to be rigidly connected to the middle part and to receive the pipe. The control crown and the first tube include respective screwing means enabling screwing of one onto the other. Second indexing means integral with the middle part are envisaged to engage with the first indexing means of the first tube. Also, the first tube and the second tube are formed such that the rigid connection of the second tube with the middle part carries out the axial locking on the first tube in relation to the middle part, a banking surface, particularly a banking surface of the first tube, coming into contact with a stopping surface, particularly a stopping surface of the middle part or a stopping surface of a ring fastened or rigidly connected to the middle part.

The document EP1857892 held by SWATCH GROUP MANAGEMENT SERVICES describes a timepiece including a case and a crystal defining together a hole for a movement, and further including a rotatable element actuated by a control organ comprising a rod radially traversing the case, a crown fitted on a first proximal end of the rod and a pinion fitted integral in rotation on a second distal end of the rod. This control organ comprises an axial fastening part of the pinion to the rod, disposed on the proximal side of the rod. The rod/pinion/fastening part assembly includes axial locking means of the fastening part on the rod, axial locking means of the fastening part on the pinion, and radial locking means of the fastening part on one of the pinion/rod elements.

SUMMARY OF THE INVENTION

The aim of the invention is particularly that of remedying the various drawbacks of these known techniques.

More specifically, an aim of the invention is that of providing an orientable screwed crown adaptable to any watch case including a crown hole, for the orientation of this screwed crown, embodied according to a simple and economical design.

The aim of the invention is also that of providing a more reliable orientable screwed crown than those of the prior art.

The invention relates to a watch case, including a middle part with at least one through hole for receiving an orientable screwed crown, according to claim 1. The invention further relates to a timepiece, particularly a watch, including such a case.

The invention further relates to a method for assembling such an orientable screwed crown.

The invention further relates to a method for fitting such an orientable screwed crown on a watch case.

BRIEF DESCRIPTION OF THE DRAWINGS

Further features and advantages of the invention will emerge more clearly on reading the following description of a particular embodiment of the invention, given merely by way of illustrative and non-limiting example, and the appended figures, wherein.

DETAILED DESCRIPTION OF PREFERRED EMBODIMENTS

Figure 1:
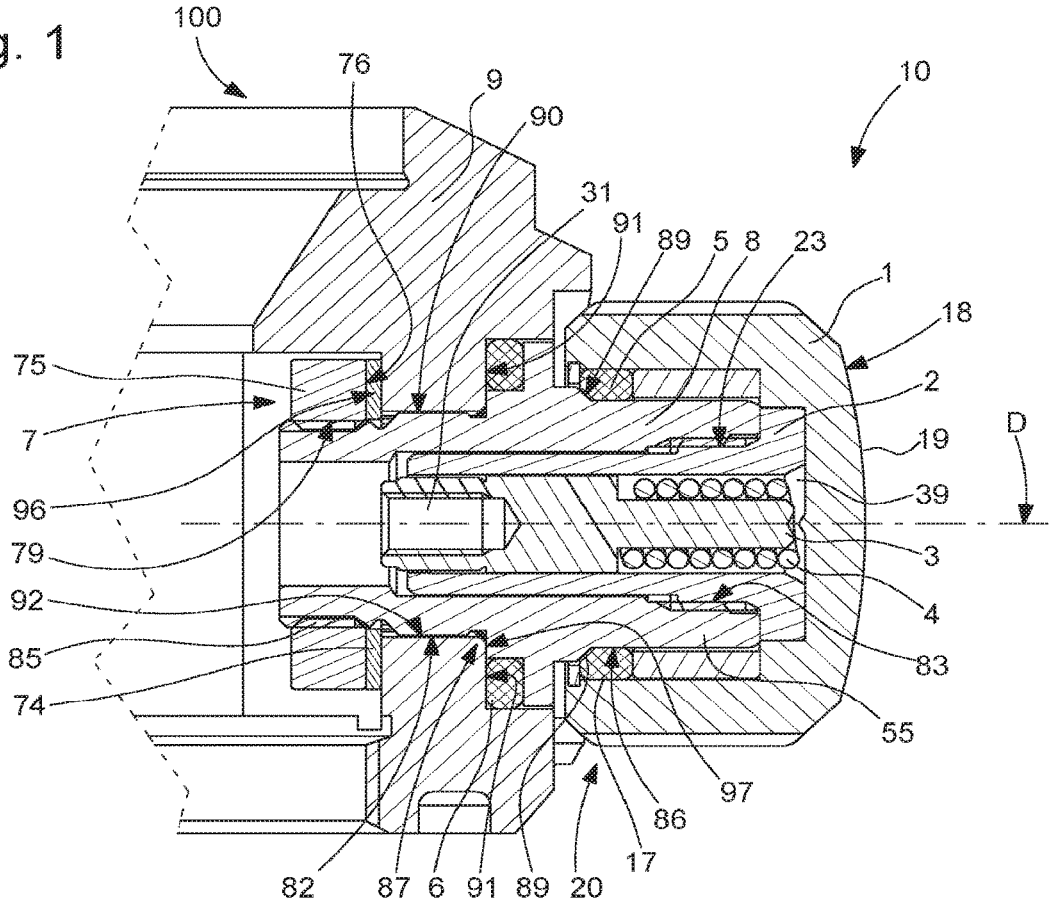
FIG. 1 is a longitudinal sectional view of a watch case including a hole with a female flute, for receiving an orientable screwed crown, including a male flute, this crown including an axial stop relative to the middle part of the case, embodied by a nut screwed onto a tube included in the crown.
Figure 2:
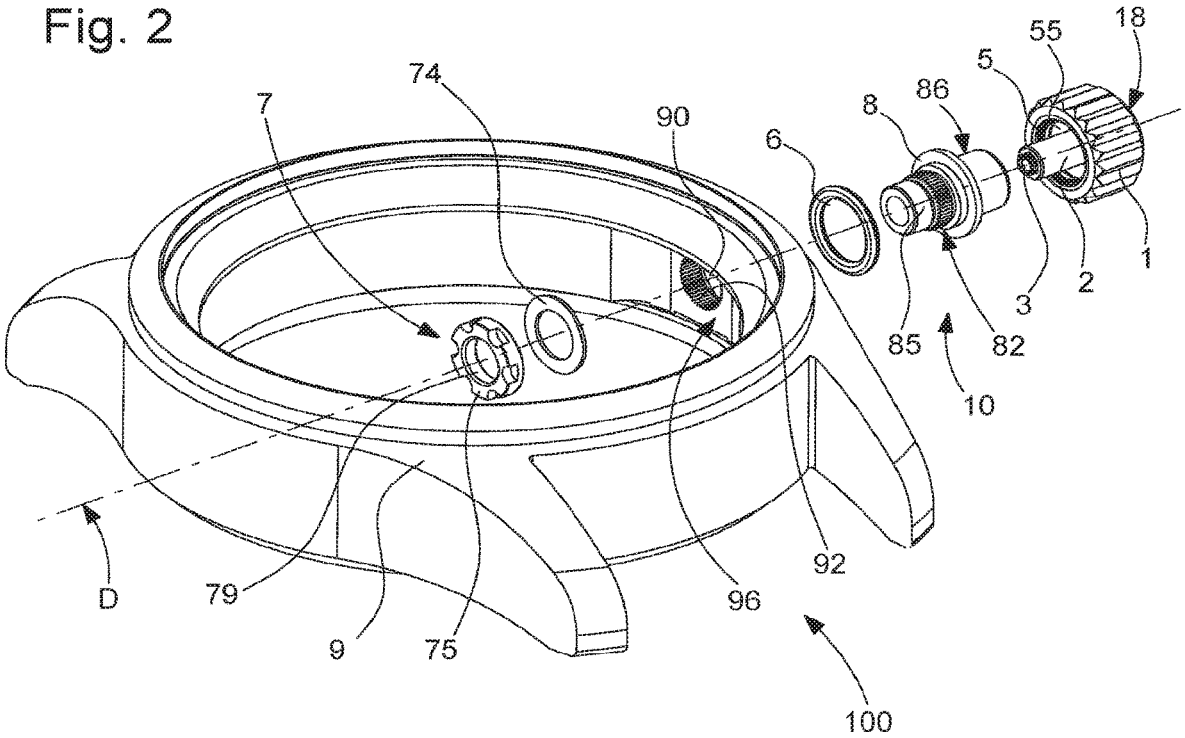
FIG. 2 is an external perspective view of the case, showing the middle part of the watch case with the female flute thereof, and the presentation of a fluted tube, for the angular indexing of the latter relative to the case, and a subassembly including a crown body suitable for being handled by the user, which contains a fixed pipe intended to be screwed into the tube, this fixed pipe containing a movable pipe envisaged to engage with the internal mechanism of the watch intended to be controlled and/or regulated by the crown.
Figure 3:
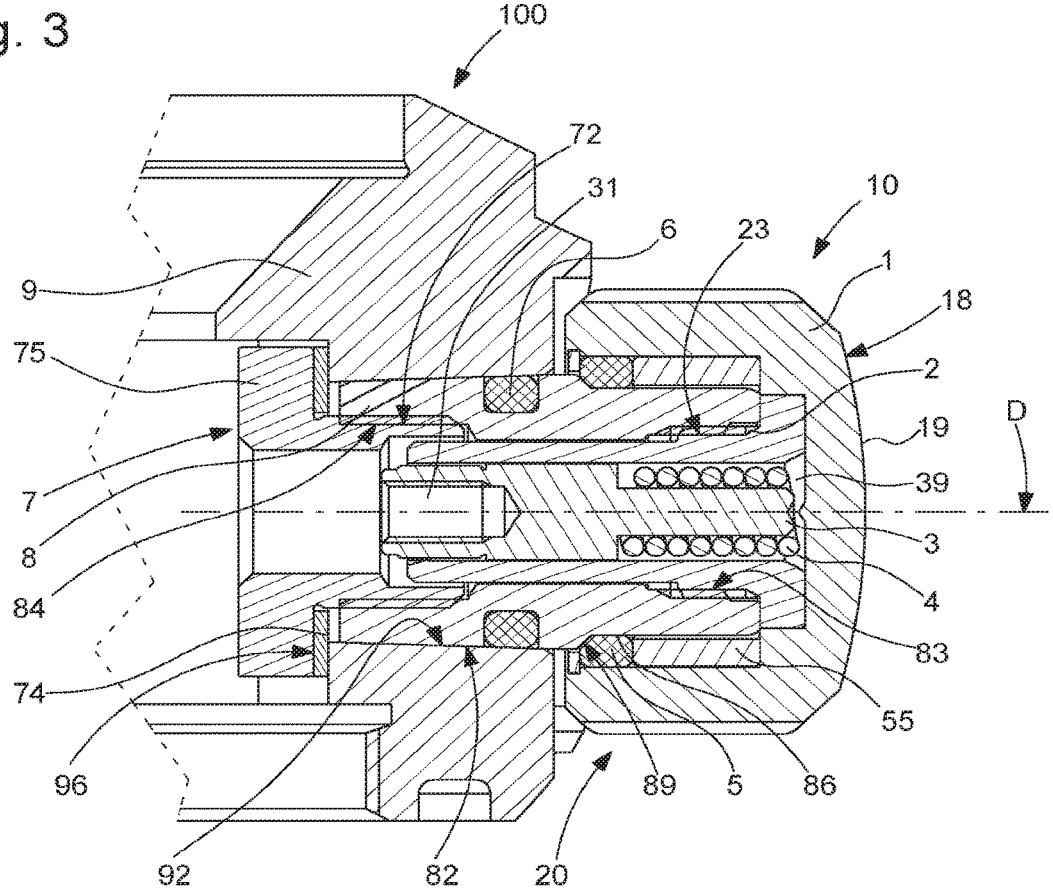
FIG. 3 is a similar view to FIG. 1, where the orientation of the crown tube, according to the invention, results from the engagement of a low-slope male cone included in this tube, and a complementary female cone included in the middle part; the axial stopping is performed by the head of a screw wherein a threading engages with a tapping of the crown tube.
Figure 4:
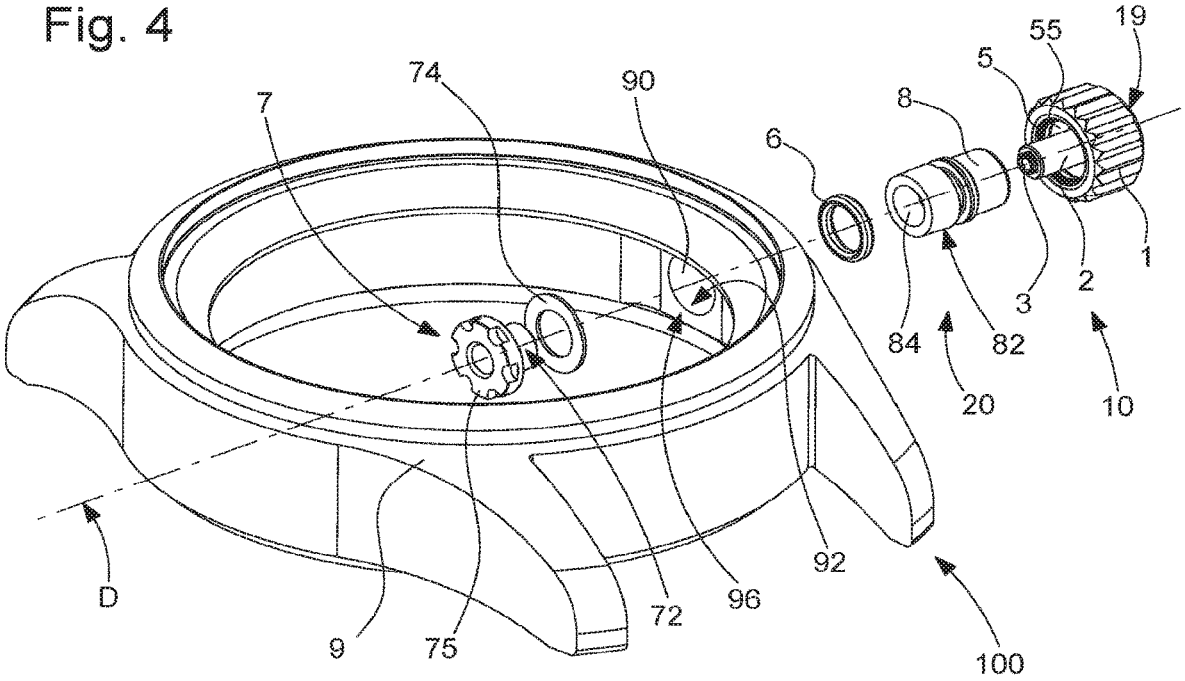
FIG. 4 is a similar view to FIG. 2, relating to the middle part and to the crown in FIG. 3.
Figure 5:
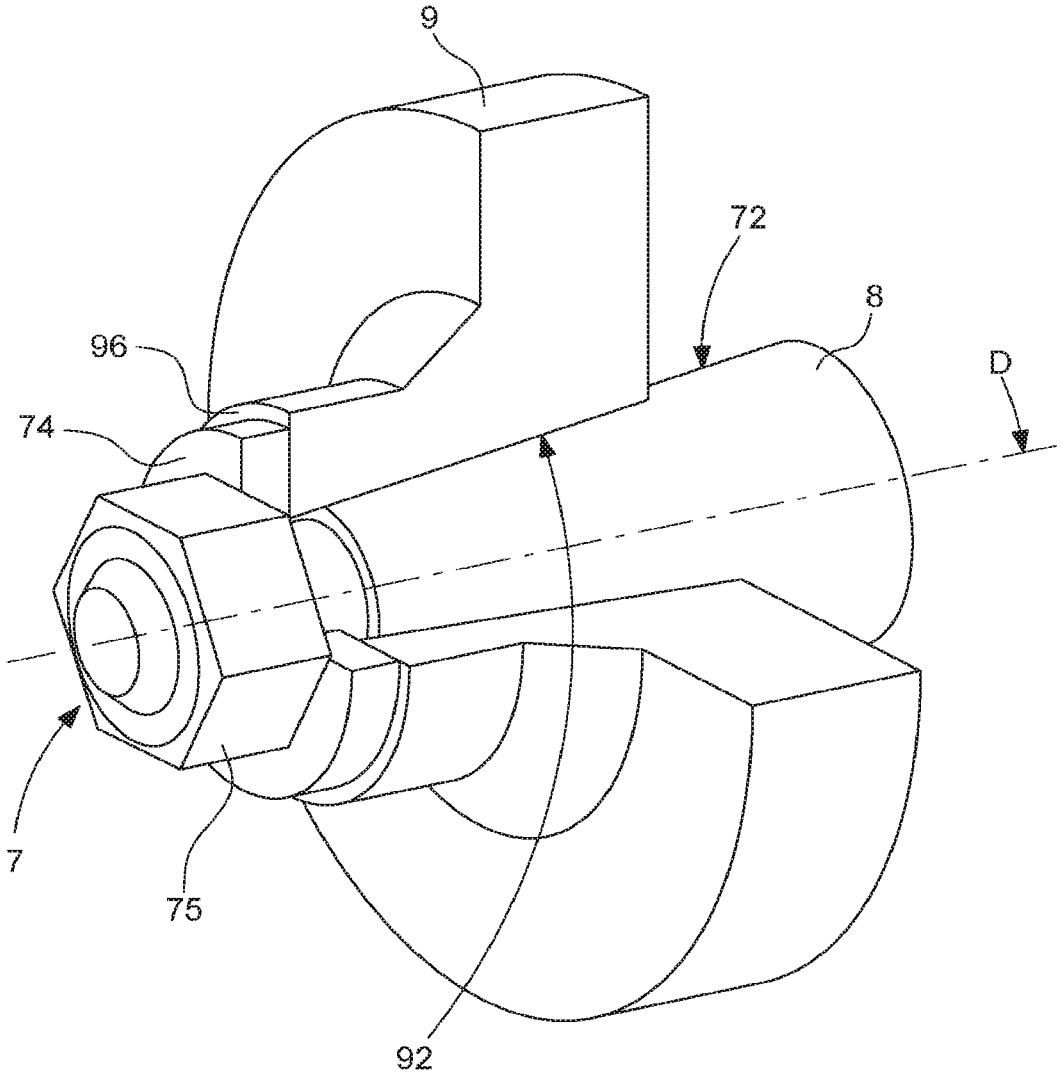
FIG. 5 is a detailed perspective, quarter cutaway, view of the embodiment in FIGS. 3 and 4, showing the engagement of the male and female cones, and the axial nut stoppage.
Figure 6:
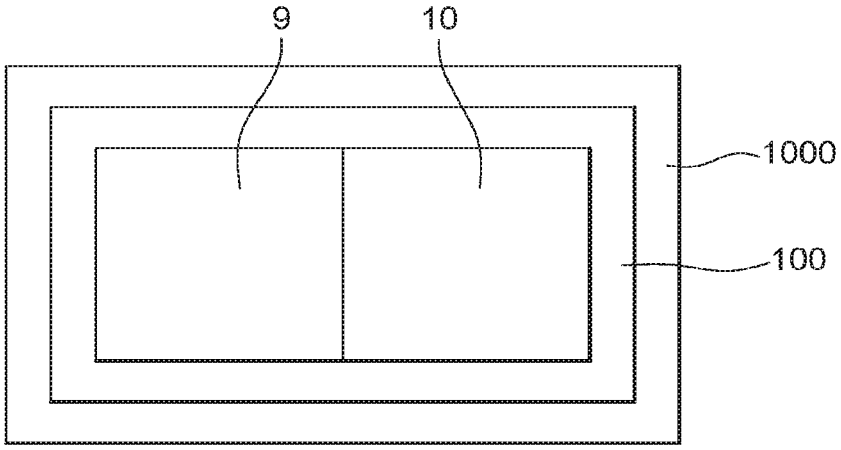
FIG. 6 is a block diagram representing a watch including a case with a middle part equipped with an orientable screwed crown according to the invention.

The invention relates to a watch case 100, including a middle part 9 with at least one through hole 90 for receiving a crown, and more particularly for receiving an orientable screwed crown 10, and an orientable screwed crown 10 arranged to engage with the hole 90 and seal same tightly.

The orientable screwed crown 10 includes a pattern 19 on an end face 18 or in the vicinity thereof.

This orientable screwed crown 10 includes, axially movable along an axial direction D in relation to one another, on one hand, a subassembly 20 including a crown body 1 suitable for being handled by a user and including the pattern 19, and, on the other, a tube 8 arranged to be inserted into the hole 90 along the axial direction D.

This tube 8 includes an indexing profile 82, which extends along the axial direction D and which is arranged to, in the inserted position in the hole 90, engage complementarily with a complementary indexing profile 92 included in the hole 90 and which extends along the axial direction D. The engagement between the indexing profile 82 and the complementary indexing profile 92 defines different possible relative indexing positions corresponding to as many relative orientations of the pattern 19 relative to the case 100.

The subassembly 20 and the tube 8 are arranged to engage by screwing along a portion of the relative axial travel thereof up to a banking position corresponding to a fully screwed position of the subassembly 20 in the tube 8.

According to the invention, the indexing profile 82 is a cone of apex angle less than 15°, and is arranged to engage by friction with the complementary indexing profile 92 of the hole 90.

In a further similar embodiment of the invention, the indexing profile 82 is either a conical toothing, or a straight flute, or a conical flute, and is arranged to engage by friction with the complementary indexing profile 92 of the hole 90.

More particularly, the case 100 includes a removable axial stopping means 7, which is arranged to, when fastened to the tube 8, axially stop, along the axial direction D, the tube 8 relative to the middle part 9. More particularly, this axial stoppage is performed by trapping the middle part 9 between, on one hand, a first banking bearing surface 87 of the tube 8 arranged to engage in axial banking bearing with a first outer banking surface 97 of the middle part, and, on the other, a second banking bearing surface 76 included in the axial stopping means 7 and which is arranged to engage in axial banking bearing with a second inner banking bearing surface 96, included in the middle part 9 on the side opposite the first outer banking surface 97.

In a further similar embodiment of the invention, the indexing profile 82 is a conical toothing, or a straight flute, or a conical flute, and the engagement between the indexing profile 82 and the complementary indexing profile 92 defines a discrete number of possible relative indexing positions corresponding to as many relative orientations of the pattern 19 relative to the case 100.

In a particular alternative embodiment of the invention where the indexing profile 82 is a cone of apex angle less than 15°, the middle part 9 and tube 8 each include a graduated scale suitable for visually marking the relative angular position thereof.

More particularly, the subassembly 20 includes, axially movable along the axial direction D against elastic return means 4 in a chamber 39 wherein it is captively fitted, a movable pipe 3 including fastening means 31 arranged for fastening the orientable screwed crown 10 to a control organ housed in the case 100.

More particularly, the subassembly 20 includes a fixed pipe 2 fastened inside the crown body 1, and bearing a threading 23 arranged to engage with a tapping 83 included in the tube 8 wherein the fixed pipe 2 is movably fitted.

More particularly, the subassembly 20 cannot be dismantled.

In a particular non-limiting example, illustrated by the figures, the fixed pipe 2 is made of one piece with the crown body 1, at the level of a laser weld 29, or gluing, or similar.

More particularly, the indexing profile 82 and the complementary indexing profile 92 include complementary flutes.

More particularly, the crown body 1 includes at least one internal annular groove 17 for receiving a first seal 5 arranged to engage with a first shoulder 86 included in the tube 8. The tube 8 includes a stopping surface 89 arranged to compress the first seal 5 during the screwing of said crown body 1 onto the tube 8. This stopping surface 89 is particularly conical or similar.

More particularly, the tube 8 includes at least one external annular groove 89 for receiving a second seal 6 arranged to engage with a sealing shoulder 91 included in the middle part 9.

In an alternative embodiment, the axial stopping means 7 is a nut 75 including a nut tapping arranged to engage with a threading 85 included in the tube 8 in the vicinity of the end thereof intended to be contained in the middle part 9.

In another alternative embodiment, the axial stopping means 7 is a nut including a nut threading 72 arranged to engage with a distal tapping 84 included in the tube 8 in the vicinity of the end thereof intended to be contained in the middle part 9.

In a further alternative embodiment, the axial stopping means 7 is a circlip housed in a circlip groove included in the tube 8 in the vicinity of the end thereof intended to be contained in the middle part 9.

In a further alternative embodiment, the axial stopping means 7 is a pin arranged to engage with a pin hole included in the tube 8 in the vicinity of the end thereof intended to be contained in the middle part 9.

The invention further relates to a timepiece, particularly a watch 1000, including such a case 100.

The invention further relates to a method for fitting such a case 100, comprising the following steps:

preparing the subassembly 20 and equipping the crown body 1 internally with a first seal 5, particularly held in a groove or bearing on a tubular spacer 55 housed in the crown body 1;

preparing the tube 8 and equipping it externally with a second seal 6;

screwing the subassembly 20 completely onto the tube 8;

inserting the group formed by the subassembly 20 and the tube 8 axially along the axial direction D in the hole 90 of the middle part 8, in the middle part 100, in the desired angular position.

More particularly, after the axial insertion of the tube 8 in the desired angular position, the removable axial stopping means 7 is fastened to the tube 8 and the tube 8 is stopped axially relative to the middle part 9, compressing the second seal 6.

More particularly, before fastening the stopping means 7, between the stopping means 7 and said middle part 9, at least one washer 74 or/and at least one elastic washer is inserted.

More particularly, after fastening the stopping means 7, the subassembly 20 is unscrewed to fasten therein a control organ housed in the case 100, then this subassembly 20 is rescrewed at the end of the screwing travel.

The invention claimed is:

1. A watch case, comprising:

a middle part;

an orientable screwed crown, wherein the middle part includes at least one through hole for receiving the orientable screwed crown, the orientable screwed crown is arranged to engage with said at least one through hole and seal the at least one through hole tightly, said orientable screwed crown includes a pattern on an end face or adjacent to the end face, said orientable screwed crown includes:

axially movable along an axial direction in relation to one another, a subassembly including a crown body suitable for being handled by a user and including said pattern, and a tube arranged to be inserted into said at least one through hole along said axial direction, said tube including an indexing profile which extends along said axial direction and which is arranged to, in an inserted position in said at least one through hole, engage complementarily with a complementary indexing profile included in said at least one through hole and which extends along the axial direction, the engagement between said indexing profile and said complementary indexing profile allowing different relative indexing positions corresponding to as many relative orientations of said pattern relative to said case after the engagement of the indexing profile and the complementary indexing profile, said subassembly and said tube being arranged to engage by screwing along a portion of the relative axial travel thereof up to a banking position corresponding to a fully screwed position of said subassembly in said tube, and said indexing profile is a cone of apex angle less than 15°, arranged to engage by friction with said complementary indexing profile of said hole.

2. The case according to claim 1, wherein said case comprises a removable axial stopping means arranged, when fastened to said tube, to axially stop, along said axial direction, said tube relative to said middle part by trapping said middle part between:

a first banking bearing surface of said tube arranged to engage in axial banking bearing with a first outer banking surface of said middle part, and a second banking bearing surface included in said axial stopping means and which is arranged to engage in axial banking bearing with a second inner banking bearing surface, included in said middle part on a side opposite said first outer banking surface.

3. The case according to claim 1, wherein said middle part and said tube each include a graduated scale suitable for visually marking g relative angular position thereof.

4. The case according to claim 1, wherein said subassembly cannot be dismantled and includes a movable pipe including fastening means, the movable pipe is axially movable along said axial direction against elastic return means in a chamber where the movable pipe is captively fitted, and the fastening means is arranged for fastening said orientable screwed crown to a control organ housed in said case.

5. The case according to claim 1, wherein said subassembly includes a fixed pipe fastened inside said crown body, and bearing a threading arranged to engage with a tapping included in said tube, and said fixed pipe is movably fitted.

6. The case according to claim 1, wherein said crown body comprises at least one internal annular groove, or a hole, for receiving at least one first seal arranged to engage with a first shoulder included in said tube which includes a stopping surface arranged to compress said first seal during the screwing of said crown body onto said tube.

7. The case according to claim 1, wherein said tube comprises at least one external annular groove or a shoulder for receiving a second seal arranged to engage with a sealing shoulder included in said middle part.

8. The case according to claim 2, wherein said axial stopping means is a tapped nut arranged to engage with a threading included in said tube adjacent to the end of the tube and to be contained in said middle part.

9. The case according to claim 2, wherein said axial stopping means is a nut including a nut threading arranged to engage with a distal tapping included in said tube adjacent to the end of the tube and to be contained in said middle part.

10. The case according to claim 2, wherein said axial stopping means is a circlip housed in a circlip groove included in said tube adjacent to the end of the tube and to be contained in said middle part.

11. The case according to claim 2, wherein said axial stopping means is a pin arranged to engage with a pin hole included in said tube adjacent to the end of the tube and to be contained in said middle part.

12. A watch comprising the case according to claim 1.

13. A method for fitting the case according to claim 1, comprising the following steps:

preparing said subassembly and equipping said crown body internally with a first seal held in a groove or bearing on a tubular spacer housed in said crown body;

preparing said tube and equipping it externally with a second seal;

screwing said subassembly completely into said tube; and inserting said tube axially along said axial direction into said hole of said middle part, in the middle part, in a desired angular position.

14. The fitting method according to claim 13, wherein for fitting a case, after the axial insertion of said tube in the desired angular position, removable axial stopping means is fastened to said tube and said tube is stopped axially relative to said middle part, compressing said second seal.

15. The fitting method according to claim 14, wherein, before fastening said stopping means, between said stopping means and said middle part, at least one washer or/and at least one elastic washer is inserted.

16. The fitting method according to claim 14, wherein, after fastening said stopping means, said subassembly is unscrewed to fasten therein a control organ housed in said case, then said subassembly is rescrewed at the end of the screwing travel.

* * * * *